US007225802B1

(12) United States Patent
Benavides

(10) Patent No.: US 7,225,802 B1
(45) Date of Patent: Jun. 5, 2007

(54) HANDBILL ASSEMBLY LAUNCHING SYSTEM

(76) Inventor: Armando W. Benavides, 2327 Castroville Rd., San Antonio, TX (US) 78237

( * ) Notice: Subject to any disclaimer, the term of this patent is extended or adjusted under 35 U.S.C. 154(b) by 0 days.

(21) Appl. No.: 11/203,941

(22) Filed: Aug. 15, 2005

Related U.S. Application Data

(60) Provisional application No. 60/602,547, filed on Aug. 18, 2004.

(51) Int. Cl.
*F41B 11/00* (2006.01)

(52) U.S. Cl. ..... 124/69

(58) Field of Classification Search ..... None
See application file for complete search history.

(56) References Cited

U.S. PATENT DOCUMENTS

| | | | | |
|---|---|---|---|---|
| 1,066,990 | A | 7/1913 | Briggs et al. | |
| 1,335,448 | A | 3/1920 | Menon | |
| 1,488,761 | A | 4/1924 | MacMillan | |
| 1,902,856 | A | 3/1933 | Jackson | |
| 2,031,988 | A | 2/1936 | Tobelman | |
| 2,116,860 | A | 5/1938 | Blaylock et al. | |
| 2,620,189 | A | 12/1952 | Livermon | |
| 2,756,737 | A | 7/1956 | Resch, Jr. | |
| 3,046,694 | A | 7/1962 | Holderer | |
| 3,130,865 | A | 4/1964 | Ono et al. | |
| 3,138,382 | A | 6/1964 | Baker et al. | |
| 3,345,977 | A | 10/1967 | Hall | |
| 3,653,538 | A | 4/1972 | Lamar | |
| 4,240,769 | A | 12/1980 | Diaz | |
| 4,748,793 | A * | 6/1988 | Brookman | 53/119 |
| 5,553,599 | A | 9/1996 | Benavides | |

OTHER PUBLICATIONS

Declaration of Armando W. Benavides, Apr. 18, 2006.
Provisional application (portion?) by Duncan and Lavin (referenced in Document 17).

* cited by examiner

*Primary Examiner*—Michael J. Carone
*Assistant Examiner*—Gabriel J. Klein
(74) *Attorney, Agent, or Firm*—George S. Gray

(57) ABSTRACT

A moisture resistant handbill is rolled to form a coil that is retained within a collapsible cup as it is ejected from an elongated tube and delivered to its destination. The collapsible cup has a cylindrical wall and a bottom member at one end that does not contribute to the structural strength of the cup. The elongated tube is connected to a controllable source of pressurized fluid that is used to eject the handbill assembly from the tube. The handbill assembly and delivery system avoids the problems of prior assemblies and systems that projected cone-shaped paper flyers through the air. Moisture resistance is provided by a plastic sheet, which may be larger than the coiled handbill, that wraps the handbill along its length prior to insertion.

7 Claims, 6 Drawing Sheets

106

HANDBILL ASSEMBLY LAUNCHING SYSTEM

CROSS-REFERENCE TO PRIOR APPLICATION

This application claims priority from U.S. Provisional Patent Application Ser. No. 60/602,547, filed Aug. 18, 2004, the inventor being Armando W. Benavides.

BACKGROUND OF THE INVENTION

1. Field of the Invention

This invention relates generally to a system for pneumatically launching a handbill assembly from a tube.

2. Description of Related Art

A system for launching handbill assemblies by pneumatic ejection from a tube is disclosed in U.S. Pat. No. 5,553,599. The system is described as prior art in the Detailed Description of Exemplary Embodiments set forth herein, and includes an elongated tube with one closed end, having coiled handbill sheets inserted in the tube. Another system, uses shrink-wrapped, coiled handbill sheets with no tube.

While the foregoing launchable handbill assembly systems may function generally with respect to the purposes for which they were designed, they would not be as suitable for the purposes of the present invention, as hereinafter described. For example, such systems do not provide what is needed, that is an enhanced pneumatically launched handbill assemblies utilizing improved materials and configurations for displaying messages on ejectable handbills, protecting the handbill sheets from the elements, and optimizing the interaction between the handbill assembly and the pressurized fluid used to pneumatically eject the handbill assembly.

SUMMARY OF THE INVENTION

The present invention enhances the pneumatically launched handbill assemblies of the prior art by providing improved materials and configurations for displaying messages on ejectable handbills, protecting the handbill sheets from the elements, and optimizing the interaction between the handbill assembly and the pressurized fluid used to pneumatically eject the handbill assembly.

The present invention provides a handbill assembly for a pneumatic ejection system, comprising: a cup member consisting of a readily collapsible cylindrical wall having a predefined internal diameter and two ends spaced apart at a predetermined distance, a nonstructural bottom member extending across one of said ends of the cylindrical wall and forming a closed end of said cup, and an open top at the other of said ends; and a handbill consisting of a plastic sheet and at least one sheet of paper rolled to form a coil with the plastic sheet on the outside of the coil, the coil having a length no more than about three times as long as the spaced distance between the ends of the cylindrical wall of the collapsible cup, the coil having a first portion extending along said coil length, the coil having a second portion extending along the remainder of said length, the coil having an unrestrained diameter greater than the internal diameter of the cylindrical wall component of said cup, said coil first portion extending being disposed within the cup and said second portion extending outwardly from the open end of said cup.

In some exemplary embodiments, the plastic sheet and the at least one paper sheet each have a width and side edges, the plastic sheet having the wider width, such that when the plastic sheet and the at least one paper sheet are rolled into the coil, the plastic sheet side edges extend beyond the at least one paper sheet side edges.

In some exemplary embodiments, the plastic sheet and the at least one paper sheet each have a length, a width, and side edges, the plastic sheet having the longer length and wider width, such that when the plastic sheet and the at least one paper sheet are rolled into the coil, the plastic sheet side edges extend beyond the at least one paper sheet side edges.

In some exemplary embodiments, the plastic sheet has a first and second side, the plastic sheet being rolled such that the first side is exposed, the first sheet first side having a message visible on the coil. In some exemplary embodiments, the message is positioned on the plastic sheet first side such that substantially all the message is visible on the coil second portion.

In some exemplary embodiments, the cup cylindrical wall has an exterior surface, the wall exterior surface having a message.

In some exemplary embodiments, the plastic sheet is a plastic laminated paper sheet.

In some exemplary embodiments, the present invention provides a handbill assembly for a pneumatic ejection system, comprising: a cup member consisting of a readily collapsible cylindrical wall having a predefined internal diameter and two ends spaced apart at a predetermined distance, a nonstructural bottom member extending across one of said ends of the cylindrical wall and forming a closed end of said cup, and an open top at the other of said ends; and a handbill consisting of at least one sheet rolled to form a coil, the coil having a length no more than about three times as long as the spaced distance between the ends of the cylindrical wall of the collapsible cup, the coil having a first portion extending along said coil length, the coil having a second portion extending along the remainder of said length, the coil having an unrestrained diameter greater than the internal diameter of the cylindrical wall component of said cup, said coil first portion extending being disposed within the cup and said second portion extending outwardly from the open end of said cup; wherein the cup cylindrical wall has an exterior surface, the wall exterior surface having a message The foregoing features and advantages of my invention will be apparent from the following more particular descriptions of exemplary embodiments of the invention as illustrated, in some embodiments, in the accompanying drawings.

DETAILED DESCRIPTION OF EXEMPLARY EMBODIMENTS

The following discussion describes exemplary embodiments of the invention in detail. This discussion should not be construed, however, as limiting the invention to those particular embodiments. Practitioners skilled in the art will recognize numerous other embodiments as well. For a definition of the complete scope of the invention, the reader is directed to the appended claims.

Figure 1:
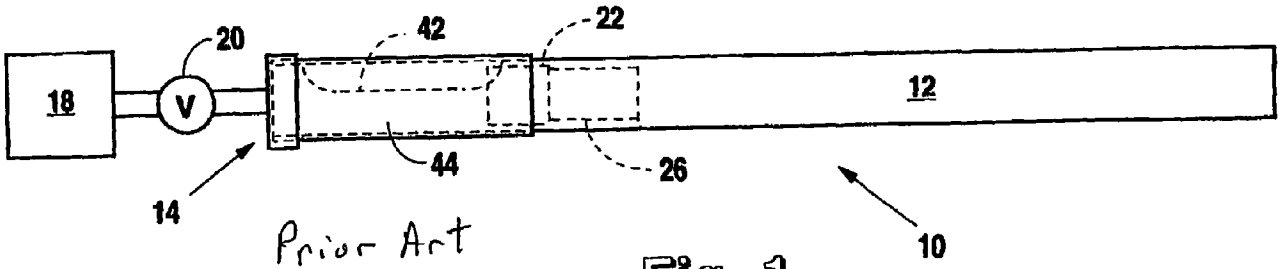
Prior Art Fig. 1
FIG. 1 is a side view of a prior art pneumatic launcher for handbill assemblies.
Figure 3:
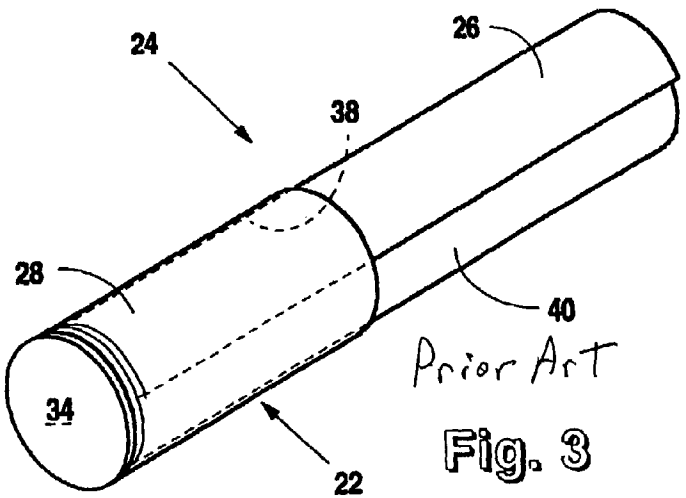
Prior Art Fig. 3
FIG. 3 is a perspective view of a prior art handbill assembly.
Figure 2:
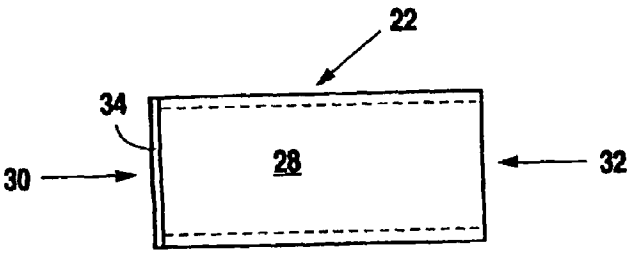
Prior Art Fig. 2
FIG. 2 is a side view of a prior art handbill assembly tube with only one open end.

As used herein, the term "Benavides '559" means the prior art handbill assembly and delivery system described in U.S. Pat. No. 5,553,599, the disclosures of such patent being incorporated herein by reference. FIG. 1, FIG. 2 and FIG. 3 herein are the same as FIG. 1, FIG. 2 and FIG. 3 of such patent.

The current invention improves upon the Benavides '559 system, while, though in some exemplary embodiments herein, one or more components of such system are utilized. The following is a description of the prior art Benavides '559 system.

The Benavides '559 handbill delivery system 10 is shown schematically in FIG. 1, and includes an elongated tube 12 having a closed end 14 and an open end 16 spaced from the dosed end 14. In one of the Benavides '559 embodiments an elongated tube 12 is formed of conventional PVC plastic pipe having a nominal diameter of 3.175 cm (1¼ in). The actual internal diameter of the pipe forming the tube 12 is 3.5 cm (1⅜ in), and in the illustrative example described herein, has a length extending between the spaced ends 14,16 of about 91 cm (3 ft).

The Benavides '559 handbill delivery system 10 also includes a source of compressed fluid 18, such as a portable air compressor or pressurized tank of air or other gas. A control valve 20 to control the flow of compressed fluid from the source 18 to the closed end 14 of the elongated tube 12 is connected by a flexible pressure hose to both components. In some embodiments of the Benavides '559 system, the source of pressurized fluid 18 is a portable, gas engine driven, air compressor having a rating of 9.7 cfm (0.046 $m^3/s$) of compressed air at a pressure of 90 psi (62 $N/cm^2$). A pressure regulator, not shown, is set to provide 100 psi (69 $N/cm^2$) supply pressure to the closed end 14 of the tube 12. The control valve 20 is a trigger actuated valve commonly used with a conventional blow nozzle.

A key component of the Benavides '559 handbill delivery system 10 is a collapsible cup 22, shown in FIG. 2, which forms one component of a handbill assembly 24. The term "cup" as used herein means a receptacle having an open top and a closed bottom. The terms "collapsible cup" and "readily collapsible wall" mean a cup or cup wall that can be easily crushed, or collapsed along its length if stepped on, even by a child. More specifically, the terms mean that the cup or cup wail will collapse when a static load of 6.8 kg (15 lbs) is applied to the respective structure. This feature of the present invention is important to present slipping in the event someone should step on a handbill assembly 24 that may be lying on a porch, sidewalk or driveway after delivery. If the cup 22, or the walls of the cup, are too rigid, the cup 22 will resist crushing and could roll, causing a person stepping on the cup to lose their balance. For this reason, it is important that the cup 22 itself and, as described below in more detail, its wall be readily collapsible.

As best shown in FIG. 2, the Benavides '559 collapsible cup 22 has a readily collapsible cylindrical wall 28, or tube, that is preferably constructed of lightweight cardboard or pasteboard. Cardboard or pasteboard are the preferred materials for the cup because they are economical and environmentally benign. However, the cup 22 may be constructed of other materials, such as plastic or metal foil, if the resultant structure is readily collapsible as defined above. The cylindrical wall 28 has predefined internal and external diameters, and a length that extends between a first end 30 and a spaced second end 32. Preferably, the collapsible cylindrical wall 28 has an internal diameter of from about 1.27 cm (0.5 in) to about 5.08 cm (2.0 inch), a wall thickness of from about 0.1 cm (0.04 in) to about 0.4 cm (0.16 in), and a length of from about 2.5 cm (1.0 in) to about 10.2 cm (4.0 in). In some embodiments of the Benavides '559 system, the internal diameter of the collapsible cylindrical wall 28 is about 3.0 cm (1.18 in), the external diameter about 3.4 cm (1.34 in), the wall thickness about 0.2 cm (0.08 in), and the length about 5.1 cm (2.0 in). Thus the outside diameter of the cylindrical wall 28 is only 0.1 cm (0.04 in) less than the internal diameter of the elongated tube 12, thus assuring minimal loss of pressurized fluid around the periphery of the cup member 22 during ejection. Preferably, the length of the cup member 22 is from about 1.5 to 4.0 times the internal diameter of the cylindrical wall 28 of the cup 22. In the above illustrative embodiment of the Benavides '559 system, the length of the cup member 22, defined as the distance between the spaced ends 30,32, is about 1.7 times the internal diameter of the cylindrical wall 28.

In some embodiments of the Benavides '559, a bottom member 34 provides a nonstructural covering across the first end 30 of the collapsible cup member 22. The term "nonstructural" as used herein with respect to the bottom member 34 means that the bottom member 34 does not add any significant structural strength, or resistance to crushing, to the cylindrical wall 28. This feature of the present invention is important to assure that the cup member 22 retains its "readily collapsible" characteristics as described above.

In some exemplary embodiments of the Benavides '559 system, the bottom member 34 is a circular disk having an diameter substantially equal to the outside diameter of the cylindrical wall 28 and constructed of single ply paper having a standard weight of 50 lbs (22.7 kg). The single ply paper is adhesively attached to the first end 30 of the collapsible cup 22 by paste or glue. The bottom member 34 should have sufficient tear resistance to avoid splitting when impinged upon by compressed air during ejection from the elongated tube 12, yet not be so tightly adhered or structurally robust that it undesirably increases the crushability, or collapsibility, of the cylindrical wall 28. For these reasons, it is preferred that the bottom member be constructed of single ply paper having a standard weight of at least 16 lbs (7.3 kg) and no more than 110 lbs (49.9 kg). Alternatively, the bottom member 34 may be formed of a thin disk having a diameter substantially equal to the interior diameter of the cylindrical wall 28 and retained by either a nonstructural adhesive or by crimping a portion of the cylindrical wall 28 over the disk. In another arrangement, the bottom member 34 may be formed by crimping the cylindrical wall 28 to form a closure across the first end 30 similar to the crimped end of a shotgun shell or container for B-Bs. In another arrangement, the cup member 22 may be formed of papier-mache with the bottom member 34 integrally formed with the cylindrical wall 28 as a single molded article. Regardless of the construction of the bottom member 34, it is important that the bottom member 34 not disadvantageously contribute to the crush resistance of the cup member 22.

In some exemplary embodiments of the Benavides '559 system, the second end 32 of the cup member 22 is open and serves as a receiver for the handbill 26. The term "handbill"

as used with respect to the Benavides '559 system means one or more sheets of a flyer, circular, leaflet, notice, placard, advertisement, commercial document or other paper. In forming the handbill assembly 24 embodying the present invention, the handbill 26 is rolled along either its width or length to form a coil having an unrestrained diameter that is greater than the internal diameter of the cylindrical wall 28 of the cup member 22. The paper, or papers, comprising the handbill 26 are loosely rolled and inserted into the second end 32 of the cup member 22 where, upon release, the rolled coil expands against the interior surface of the cylindrical wall 28 with sufficient force to retain the handbill 26 in the cup member 22 during ejection from the elongated tube 12 and subsequent flight through the air to its delivery destination. Upon insertion in the cup 22, a first portion 38 of the coiled handbill 26, extending along its coiled length, is positioned within the cup 22. To assure retention of the handbill 26 in the cup during ejection, flight and delivery, the first portion 38 of the rolled, or coiled, handbill 26 should be at least ⅓ of the total coiled length of the handbill 26, with the remaining, or second, portion 40 extending outwardly from the second end 32 of the cup 22. In this illustrative example of the Benavides '559 system, the handbill 26 includes two sheets of heavy weight paper, one measuring 10.8 cm (4¼ in) by 27.9 cm (11 in), and the other sheet measuring 9.5 cm (3¾ in) by 21.6 cm (8½ in), and having a combined weight of 8.5 g (0.3 oz).

Generally, in the Benavides '559 system, several sheets of paper or handbills 26, depending upon their size and weight, can be rolled simultaneously, and inserted as a unit into the cup 22. However, there are several important considerations that should be addressed. First, the number of papers 26 inserted into the cup member 22 should not be so great as to inhibit the collapsibility of the cup member 22. Secondly, the total weight of the handbill assembly 24, including both cup member 22 and handbill 26, should not be so heavy as to be harmful if it should strike a person, window, or other structure during flight. For this reason, the total weight of the handbill assembly 24 should not exceed a few ounces. However, the total weight of the handbill assembly 24 must be sufficient to provide adequate throw distance. Preferably, the handbill assembly 24 has a weight of at least 5.7 g (0.2 oz), but no more than 113 g (4.0 oz).

In the illustrative embodiment of the Benavides '559 system described above, the handbill 26 comprises two sheets of heavy paper weighing about 8.5 g (0.3 oz), and the total weight of the handbill assembly 24, including the collapsible cup member 22, is about 17 g (0.6 oz). The handbill 26 was rolled with fire smaller sheet inside the larger sheet so that the length of the coiled roll was the width of the larger sheet, i.e., 10.8 cm (4¼ in). To assure proper balance of the handbill assembly 24 during ejection, rotation during flight, and cup-end delivery, it is desirable that the center of gravity, or balance point, of the handbill assembly 24 be positioned between the spaced ends 30.32 of the cup member 22. This means that the second portion 40 of the handbill 26 extending outwardly of the second end 32 of the cup 22 should not have a weight that is greater than the combined weight of the first portion 38 of the handbill 26 and the cup member 22.

In carrying out the delivery of handbills 26 using the delivery system 10 of the Benavides '559 system, the elongated tube 12 has a longitudinal opening 42 adjacent the closed end 14 of the tube 12. The opening 42 has a width and length sufficient to receive one of the handbill assemblies 24. During ejection of the handbill assembly 24 from the elongated tube 12, the opening 42 is covered by sleeve 44 that is slidably mounted on the exterior of the tube 12 and positioned at a first position as shown in FIG. 1. The opening 42 is accessed for insertion of the handbill assembly 24 by sliding the sleeve 44 along the tube, toward the open end 16, to a second position spaced from the opening 42.

An important advantage of the handbill delivery system 10 of the Benavides '559 system is that the handbill assembly 24 does not need to be precisely positioned within the elongated tube 12, as was required in the aforementioned system for delivering a paper cone. The handbill assembly 24 is inserted through the opening 42 with the bottom member 34 of the cup 22 facing toward the closed end 14 of the tube 12. The handbill assembly 24 may be inserted anywhere along the opening 42 and either left at that position in the tube 12, or even placed forward of the opening 42. It is not necessary that the bottom member 34 of the cup member 22 be positioned in contact with, or even closely adjacent, the closed end 14 of the elongated tube 12. After insertion of the handbill assembly 24 into the elongated tube 12, the sleeve 44 is moved to its first, or covering position over the opening 42. When it is desired to eject the handbill assembly, the valve 20, connected to a pressure line from the air compressor 18, is momentarily opened to admit pressurized fluid into the interior of the tube 12 through the pressure line connected to a fitting in the closed end 14 of the tube 12. The pressurized air then ejects the handbill assembly 24, the second portion 40 of the handbill 26 end first, through the open end 16 of the elongated tube 12. Immediately after leaving the open end 16 of the tube 12, the handbill assembly 24 rotates, or tumbles, end for end so that the cup end of the assembly 24 lands first. This feature assures good aerodynamic flow around the handbill assembly 24 during flight and makes it possible for an operator of the delivery system 10 to accurately spot the delivery position of the handbill assembly 24.

In the above described illustrative embodiment of the Benavides '559 system, the elongated tube 12 has a length of about 91 cm (3.0 ft), and is capable, with the above stated 100 psi (69 $N/cm^2$) supply pressure, of projecting the described handbill assembly 24 having a weight of about 17 grams (0.6 oz), a distance of about 15 m (50 ft). It has been found that the flight distance of the ejected handbill assembly 24 can be increased by using a higher supply pressure or a longer tube 12, or a combination of both. Similarly, the flight distance may be decreased by either lowering the supply pressure or shortening the length of the elongated tube 12, or a combination of both.

Figure 4:
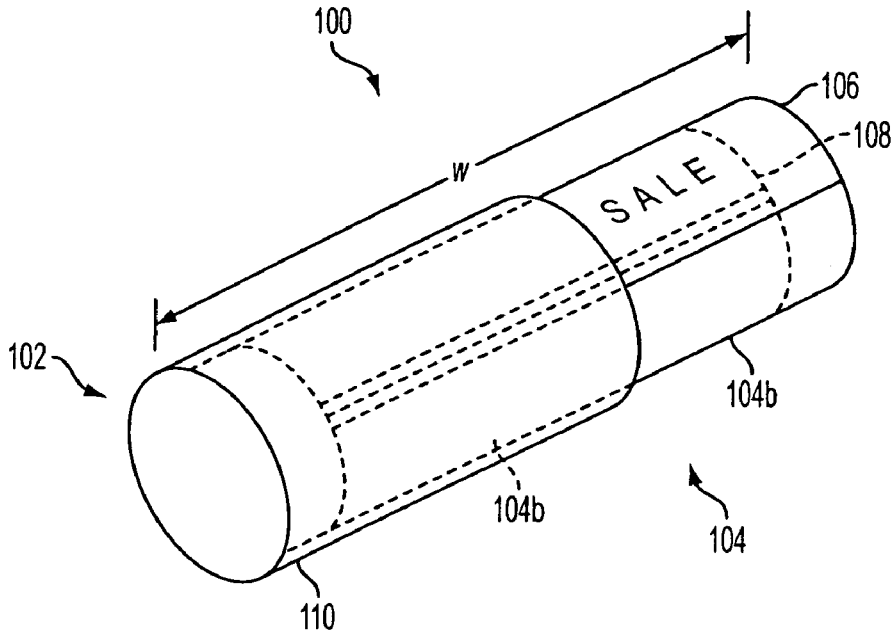
FIG. 4 is a perspective view of an exemplary embodiment of the handbill assembly of the present invention.
Figure 5:
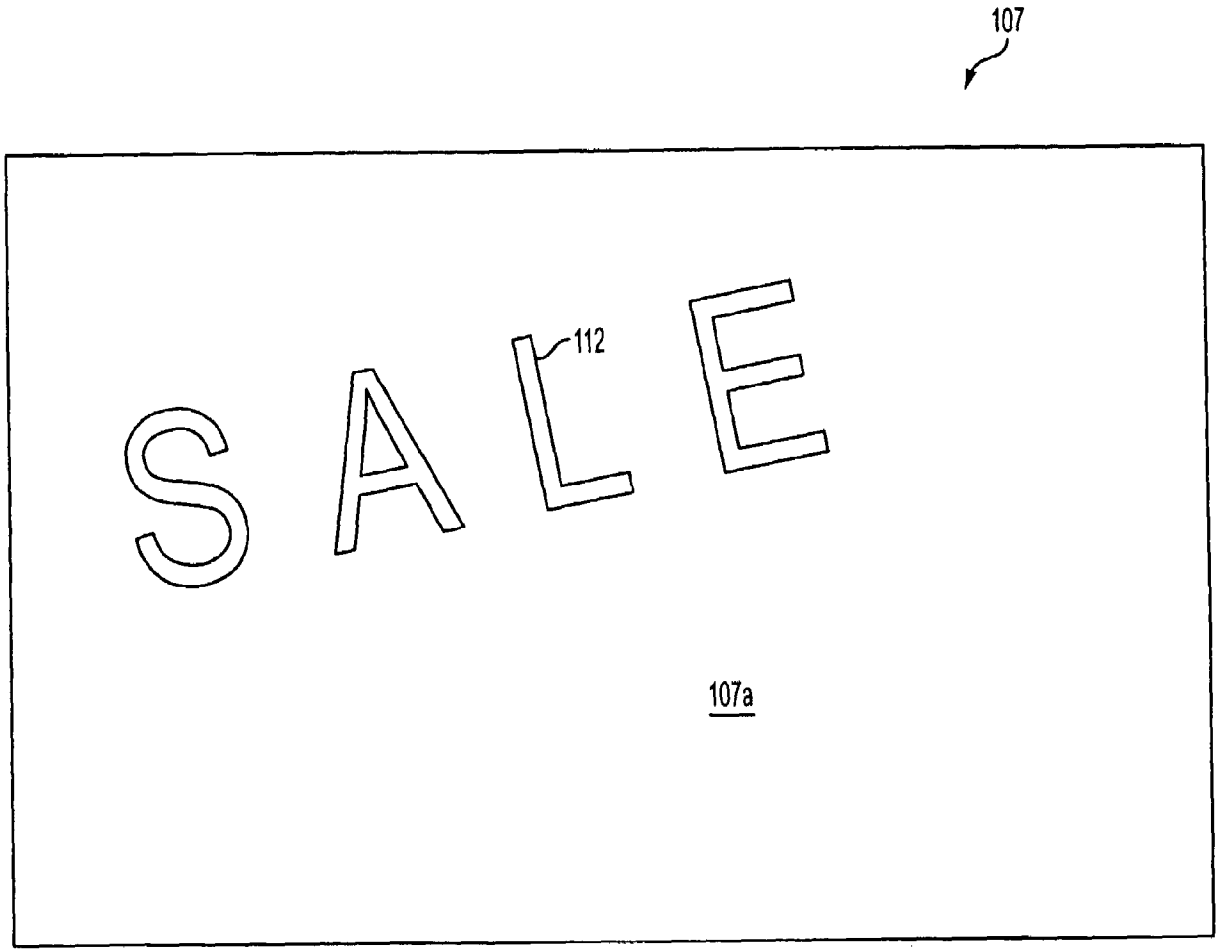
FIG. 5 is a top view of an exemplary plastic sheet.
Figure 6:
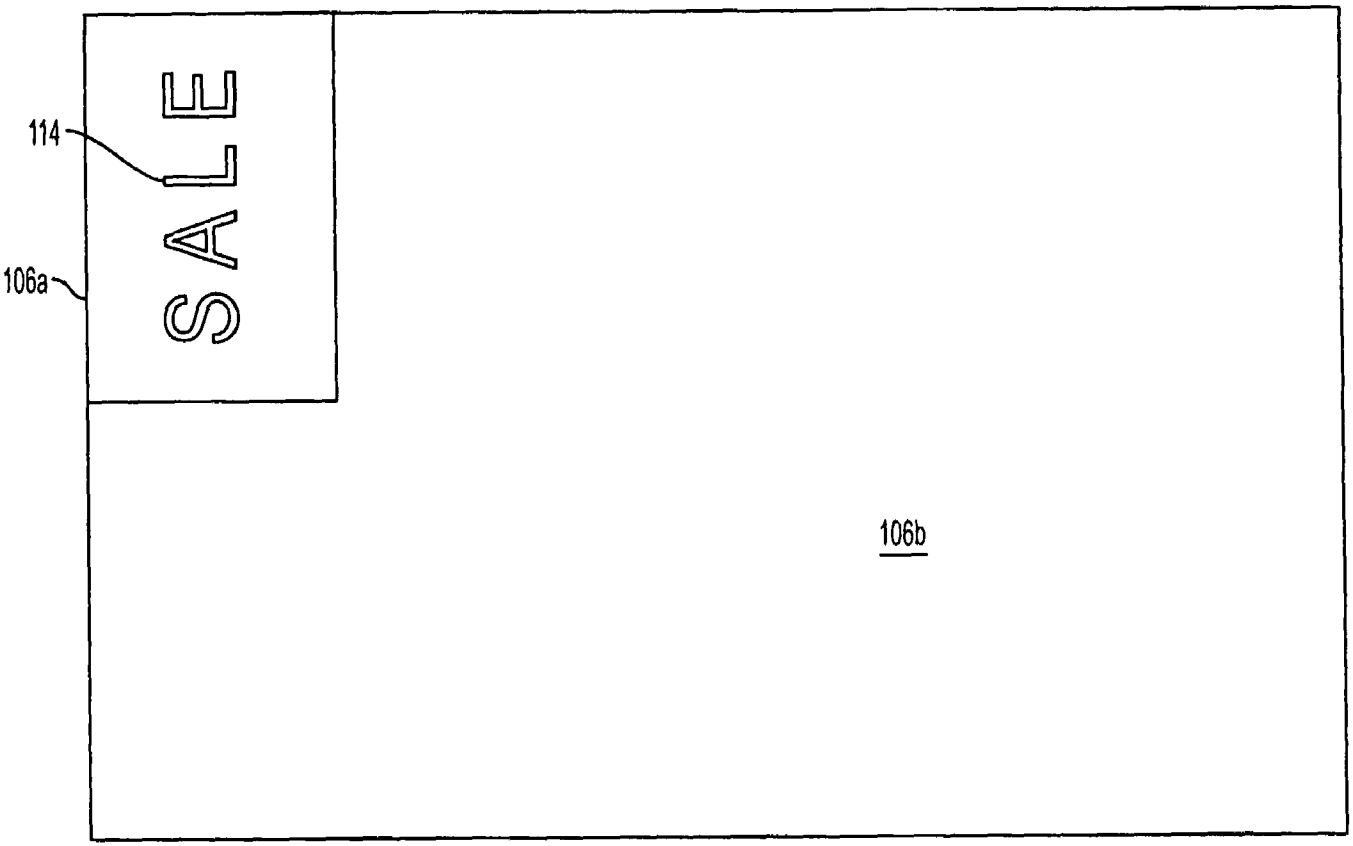
FIG. 6 is a top view of an exemplary plastic sheet.

Turning now to the present invention, FIG. 4 depicts an exemplary embodiment of a handbill assembly 100 for a pneumatic ejection assembly such as that depicted in FIG. 1. In this exemplary embodiment, a cup member 102 is the same or similar to the cup 22 of the Benavides '559 system. A handbill 104 in some embodiments of the present invention, however, is formed from a plastic sheet 106 and at least one sheet of paper 108 rolled to form the handbill into a coil with the plastic sheet on the outside of the coil. An exemplary plastic sheet 106 is depicted in FIG. 6. And a second exemplary plastic sheet 107 is depicted in FIG. 5. The handbill has a first portion 104*a* and a second portion 104*b*, the handbill having an unrestrained diameter greater than the internal diameter of the cylindrical wall component of the cup. The handbill first portion 104*a* is disposed within the cup and the second portion 104*b* extends outwardly from the open end of the cup.

Figure 7:
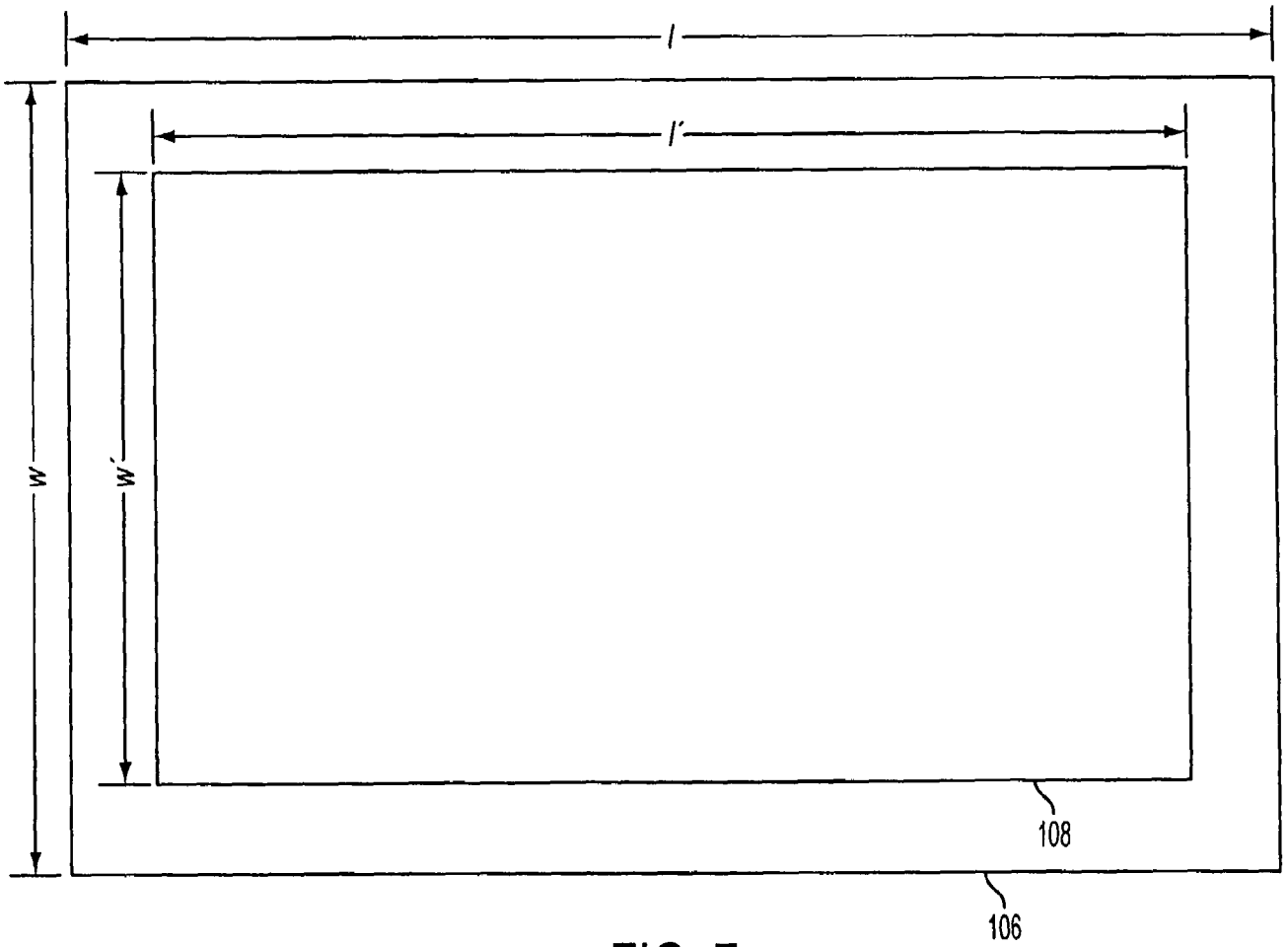
FIG. 7 is a bottom view of an exemplary plastic sheet overlaid by an exemplary paper sheet.

In some exemplary embodiments of the present invention, and as illustrated in FIG. 4 and FIG. 7, the plastic sheet 106 is larger than the paper sheets 108. The plastic sheet has a length l and a width w and the paper sheets have a length l' and a width w'. In some exemplary embodiments the plastic sheet length is longer than the paper sheet length. In some embodiments of the present invention, the plastic sheet width is wider than the paper sheet width. The sheets depicted in FIG. 7 illustrate an exemplary embodiment in which the plastic sheet is both longer and wider than the paper sheet.

As shown in the exemplary embodiment of FIG. 4, a wider plastic sheet width w enables a coiling of the handbill 104 such that the plastic sheet 106 extends further from the tube 110, thus providing protection against ground moisture and weather. In the exemplary embodiment illustrated in FIG. 7, the paper sheet is centered on the plastic sheet. In other exemplary embodiments, the undersized paper sheet is positioned off-center, but necessarily leaving a portion of the plastic sheet to extend further from the tube 110.

As further shown in the exemplary embodiment of FIG. 4, a longer plastic sheet length l enables a coiling of the handbill 104 such that the plastic sheet 106 will completely surround the paper sheets, positioning the plastic sheet edge 106*a* adjacent the plastic sheet outer surface 106*b*. This provides additional protection from ground moisture and weather.

In some exemplary embodiments of the present invention, the exemplary plastic sheet 107 depicted in FIG. 5 has a first side 107*a* that is exposed as the outer surface after the handbill is coiled. In some exemplary embodiments, a message 112, such as an advertisement, is positioned on this outer surface and remains at least partially visible after the handbill 102 is inserted in the tube 110. In some exemplary embodiments, of the type depicted in FIG. 7, a message 114 is strategically positioned on the plastic sheet outer surface 106*b* such that substantially all the message is visible on the handbill second portion 104*b*.

Figure 8:
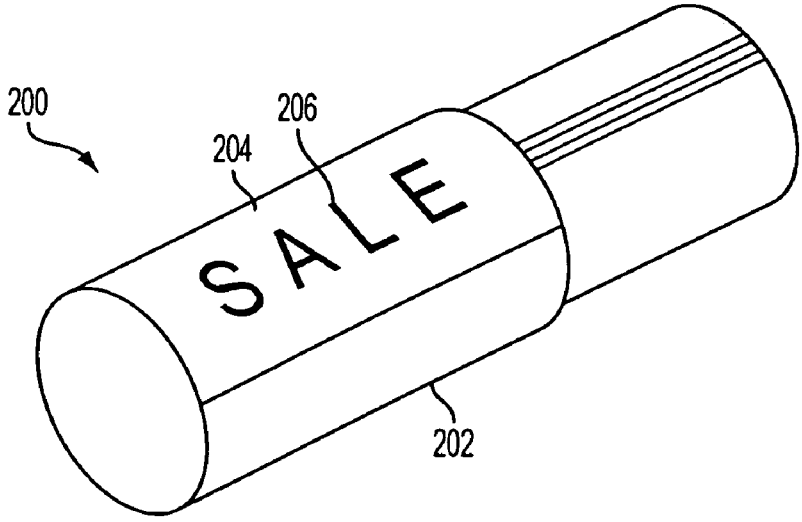
FIG. 8 is a perspective view of an exemplary embodiment of the handbill assembly of the present invention.
Figure 9:
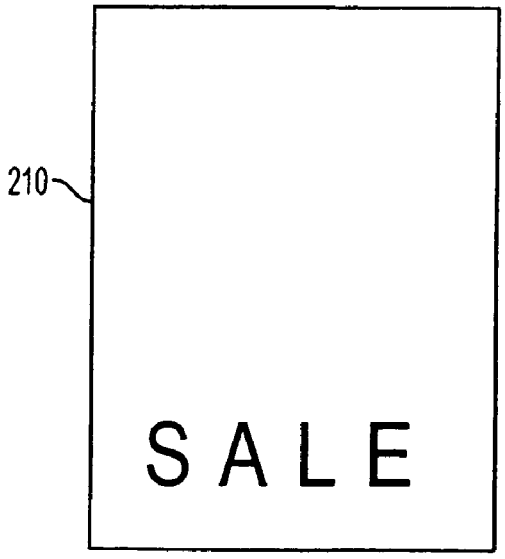
FIG. 9 is a top view of an exemplar sheet for wrapping a tube.

Returning to the prior art handbill assembly 22 of the Benavides '559 system, as depicted in FIG. 2, another exemplary embodiment 200 of the present invention provides a similar tube 202, as depicted in FIG. 8. As further shown in FIG. 8, however, the tube has an exterior surface 204 upon which is positioned a message 206. In some exemplary embodiments the message is printed directly on the tube. In some exemplary embodiments, a sheet 210, as depicted in FIG. 9, has the message positioned thereon and the sheet is adhesively attached to the tube such that the message remains visible.

With respect to the above description then, it is to be realized that the optimum dimensions and materials for a particular handbill assembly, will occur to those skilled in the art upon review of the present disclosure.

All equivalent relationships to those illustrated in the drawings and described in the specification are intended to be encompassed by the present invention.

The descriptions in this specification are for purposes of illustration only and are not to be construed in a limiting sense. The scope of the present invention is limited only by the language of the following claims.

I claim:

1. A handbill assembly for a pneumatic ejection system, comprising:

a cup member consisting of a readily collapsible cylindrical wall having a predefined internal diameter and two ends spaced apart at a predetermined distance, a nonstructural bottom member extending across one of said ends of the cylindrical wall and forming a closed end of said cup, and an open top at the other of said ends; and a handbill consisting of a plastic sheet and at least one sheet of paper rolled to form a coil with the plastic sheet on the outside of the coil, the coil having a length no more than about three times as long as the spaced distance between the ends of the cylindrical wall of the collapsible cup, the coil having a first portion extending along said coil length, the coil having a second portion extending along the remainder of said length, the coil having an unrestrained diameter greater than the internal diameter of the cylindrical wall component of said cup, said coil first portion extending being disposed within the cup and said second portion extending outwardly from the open end of said cup;

wherein the plastic sheet is a plastic laminated paper sheet.

2. The handbill assembly of claim 1, wherein the plastic sheet and the at least one paper sheet each have a width and side edges, the plastic sheet having the wider width, such that when the plastic sheet and the at least one paper sheet are rolled into the coil, the plastic sheet side edges extend beyond the at least one paper sheet side edges.

3. The handbill assembly of claim 1, wherein the plastic sheet and the at least one paper sheet each have a length, a width, and side edges, the plastic sheet having the longer length and wider width, such that when the plastic sheet and the at least one paper sheet are rolled into the coil, the plastic sheet side edges extend beyond the at least one paper sheet side edges.

4. The handbill assembly of claim 1, wherein the plastic sheet has a first and second side, the plastic sheet being rolled such that the first side is exposed, the plastic sheet first side having a message visible on the coil.

5. The handbill assembly of claim 4, wherein the message is positioned on the plastic sheet first side such that substantially all the message is visible on the coil second portion.

6. The handbill assembly of claim 1, wherein the cup cylindrical wall has an exterior surface, the wall exterior surface having a message.

7. A handbill assembly for a pneumatic ejection system, comprising:

a cup member consisting of a readily collapsible cylindrical wall having a predefined internal diameter and two ends spaced apart at a predetermined distance, a nonstructural bottom member extending across one of said ends of the cylindrical wall and forming a closed end of said cup, and an open top at the other of said ends;

a handbill consisting of at least one sheet of paper rolled to form a coil, the coil having a length no more than about three times as long as the spaced distance between the ends of the cylindrical wall of the collapsible cup, the coil having a first portion extending along said coil length, the coil having a second portion extending along the remainder of said length, the coil having an unrestrained diameter greater than the internal diameter of the cylindrical wall component of said cup, said coil first portion extending being disposed within the cup and said second portion extending outwardly from the open end of said cup; and means for making the inserted handbill moisture-resistant;

wherein the means for making the inserted handbill moisture-resistant comprises a plastic sheet, the plastic sheet and the at least one paper sheet each having a length, a width, and side edges, the plastic sheet having the longer length and wider width, such that when the plastic sheet and the at least one paper sheet are rolled into the coil, the plastic sheet side edges extend beyond the at least one paper sheet side edges; and wherein the plastic sheet is a plastic laminated paper sheet.

* * * * *